US009101250B2

(12) United States Patent
Ray

(10) Patent No.: US 9,101,250 B2
(45) Date of Patent: Aug. 11, 2015

(54) WIPES DISPENSER NOZZLE

(71) Applicant: Eugene W. Ray, Barberton, OH (US)

(72) Inventor: Eugene W. Ray, Barberton, OH (US)

(73) Assignee: GOJO Industries, Inc., Akron, OH (US)

( * ) Notice: Subject to any disclaimer, the term of this patent is extended or adjusted under 35 U.S.C. 154(b) by 211 days.

(21) Appl. No.: 13/832,750

(22) Filed: Mar. 15, 2013

(65) Prior Publication Data

US 2013/0306669 A1 Nov. 21, 2013

Related U.S. Application Data

(60) Provisional application No. 61/649,536, filed on May 21, 2012.

(51) Int. Cl.

| | |
|---|---|
| ***A47K 10/24*** | (2006.01) |
| ***B65D 83/08*** | (2006.01) |
| ***A47K 10/42*** | (2006.01) |
| ***A47K 10/38*** | (2006.01) |
| *A47K 10/32* | (2006.01) |

(52) U.S. Cl.

CPC ..... *A47K 10/24* (2013.01); *A47K 10/3818* (2013.01); *A47K 10/421* (2013.01); *B65D 83/0805* (2013.01); *A47K 2010/3266* (2013.01); *A47K 2010/3273* (2013.01)

(58) Field of Classification Search

CPC . B65D 83/0805; A47K 10/42; A47K 10/422; A47K 10/24

See application file for complete search history.

(56) References Cited

U.S. PATENT DOCUMENTS

| | | | | |
|---|---|---|---|---|
| 3,967,756 | A | 7/1976 | Barish | |
| 3,982,659 | A | 9/1976 | Ross | |
| 4,180,160 | A * | 12/1979 | Ogawa et al. | 221/63 |
| 4,534,491 | A | 8/1985 | Norton et al. | |

(Continued)

FOREIGN PATENT DOCUMENTS

| | | |
|---|---|---|
| DE | 4006987 | 9/1991 |
| GB | 2002327 | 2/1979 |

(Continued)

OTHER PUBLICATIONS

International Search Report and Written Opinion from International Application No. PCT/US2013/041927, date of mailing Jan. 24, 2014.

*Primary Examiner* — Timothy Waggoner

(74) *Attorney, Agent, or Firm* — Calfee, Halter & Griswold LLP

(57) ABSTRACT

One embodiment for dispensers for dispensing wet wipes includes a container, a plurality of wet wipes contained within the container and a dispensing nozzle made of a resilient material secured to the container. The dispensing nozzle includes an outlet opening in the nozzle. A fluid retaining member is located at a point below the opening. Another embodiment includes a container for holding a plurality of wipes. A dispensing nozzle includes a resilient member having an outlet opening is secured to the container. A fluid retaining member is located below the outlet. In one embodiment, the fluid retaining member has a surface that is sloped. Embodiments of dispensing nozzles for wet wipes are also disclosed wherein the dispensing nozzle includes a resilient dome shaped member having an opening located therein. In addition, the dispensing nozzle includes an annular fluid retaining ring. The annular fluid retaining ring may have a sloped surface.

20 Claims, 3 Drawing Sheets

(56) References Cited

U.S. PATENT DOCUMENTS

| | | | | |
|---|---|---|---|---|
| 4,601,938 | A | 7/1986 | Deacon et al. | |
| 4,651,895 | A | 3/1987 | Niske et al. | |
| 4,784,290 | A | 11/1988 | Howard | |
| 5,273,184 | A | 12/1993 | Rizzuto | |
| 5,542,567 | A | 8/1996 | Julius | |
| 5,560,514 | A | 10/1996 | Frazier | |
| 5,718,353 | A | 2/1998 | Kanfer | |
| D415,641 | S | 10/1999 | Roberts | |
| 6,145,782 | A | 11/2000 | King | |
| 6,152,322 | A | 11/2000 | Marino | |
| 6,158,614 | A | 12/2000 | Haines et al. | |
| 6,220,435 | B1 | 4/2001 | Nobile | |
| 6,328,252 | B1 | 12/2001 | Neveu et al. | |
| 6,412,656 | B1 * | 7/2002 | Placik | 221/63 |
| 6,766,919 | B2 | 7/2004 | Huang | |
| 6,786,447 | B2 | 9/2004 | Geib et al. | |
| 6,910,579 | B2 | 6/2005 | Reinke | |
| 7,172,093 | B2 | 2/2007 | Bando | |
| 7,216,760 | B2 | 5/2007 | Forrest, Jr. | |
| 7,216,775 | B2 | 5/2007 | Evans et al. | |
| 7,303,069 | B2 | 12/2007 | Forrest, Jr. | |
| 7,490,733 | B2 * | 2/2009 | Tagliareni | 221/62 |
| 7,546,930 | B2 | 6/2009 | Banik et al. | |
| 7,556,175 | B2 | 7/2009 | Simkins | |
| 7,559,434 | B2 | 7/2009 | Masting | |
| 7,628,292 | B2 | 12/2009 | Lancesseur | |
| 7,699,214 | B2 | 4/2010 | Mestre et al. | |
| 7,806,291 | B2 | 10/2010 | Anderson | |
| 7,806,292 | B2 | 10/2010 | Simkins | |
| 7,854,346 | B2 | 12/2010 | Bendor et al. | |
| 7,922,036 | B2 | 4/2011 | Bendor et al. | |
| 2010/0176021 | A1 | 7/2010 | Gordon | |
| 2012/0145737 | A1 * | 6/2012 | Ray et al. | 221/45 |

FOREIGN PATENT DOCUMENTS

| | | |
|---|---|---|
| JP | 2008100749 | 5/2008 |
| JP | 2011063291 | 3/2011 |
| JP | 2011173633 | 9/2011 |
| WO | 2000002475 | 1/2000 |

* cited by examiner

WIPES DISPENSER NOZZLE

RELATED APPLICATIONS

This non-provisional utility patent application claims priority to and the benefits of U.S. Provisional Patent Application Ser. No. 61/649,536 filed on May 21, 2012 and entitled WIPES DISPENSER NOZZLE. That provisional application is incorporated herein by reference in its entirety.

TECHNICAL FIELD

The present invention generally relates to dispensers for dispensing wipes or moist towelettes. More particularly, the present invention relates to dome dispensing nozzles.

BACKGROUND OF THE INVENTION

Wipes are typically made from a variety of materials, such as non-woven materials. Wipes are often moistened with solutions, such as antimicrobial solutions. The wipes may be stacked and folded in a container or may be in the form of a roll. Wipes in the form of a roll typically have perforations between the wipes that are strong enough to remain attached to one another so that the top of the trailing wipe is pulled up through a dispensing outlet prior to the perforations tearing away and allowing the leading wipe to be used. Accordingly, the top of the trailing wipe may be grabbed by a user and pulled out of the container.

SUMMARY

Embodiments for dispensers for dispensing wet wipes are disclosed herein. One exemplary embodiment includes a container, a plurality of wet wipes contained within the container and a dispensing nozzle made of a resilient material secured to the container. The dispensing nozzle includes an outlet opening in the nozzle. A fluid retaining member is located at a point below the opening.

Another exemplary embodiment includes a container for holding a plurality of wipes. A dispensing nozzle is secured to the container. The dispensing nozzle includes a resilient member having an outlet opening. A fluid retaining member is located below the outlet. In one embodiment the fluid retaining member has a surface that is sloped.

Embodiments of dispensing nozzles for wet wipes are also disclosed wherein the dispensing nozzle includes a resilient dome shaped member having an opening located therein. In addition, the dispensing nozzle includes an annular fluid retaining ring. The annular fluid retaining ring may have a sloped surface.

BRIEF DESCRIPTION OF THE DRAWINGS

These and other features and advantages of the present invention will become better understood with regard to the following description, and accompanying drawings where.

DETAILED DESCRIPTION

Figure 1:
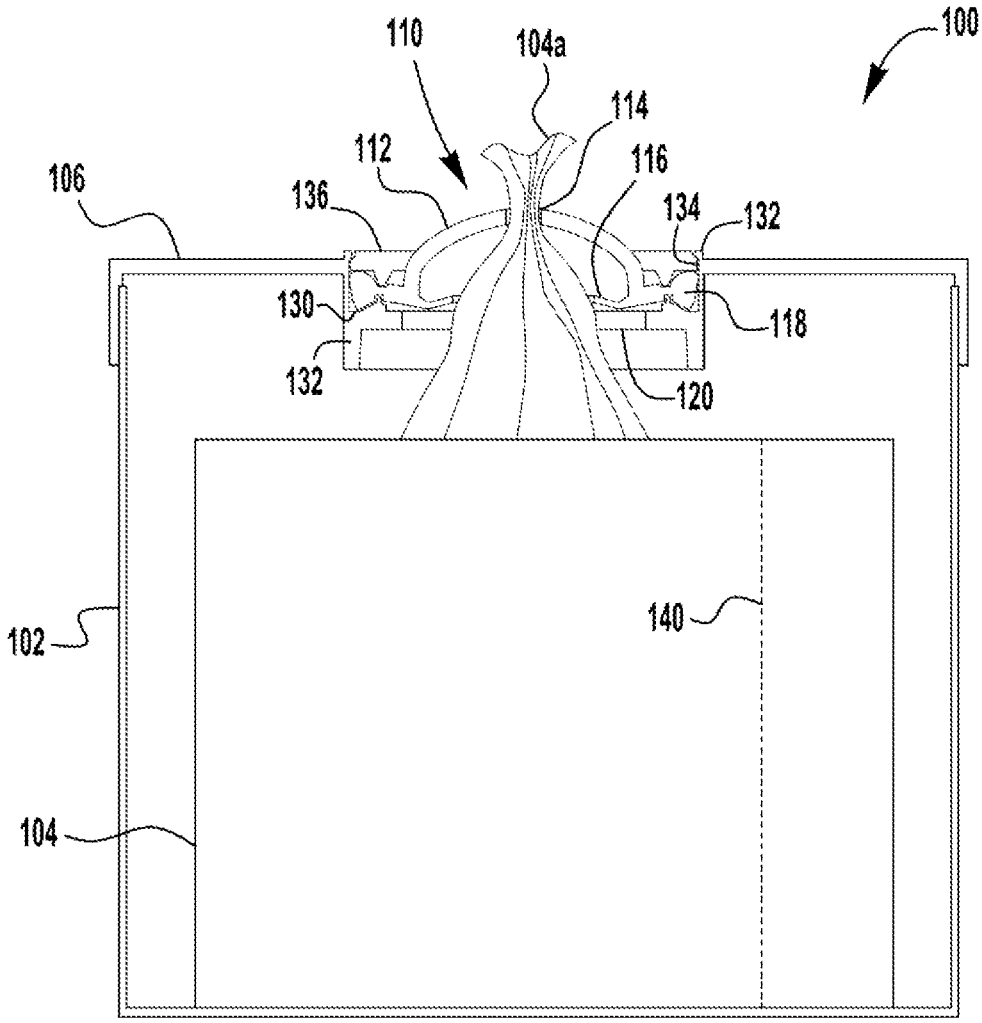
FIG. 1 illustrates a cross-sectional view of an embodiment of a wipes dispenser having a nozzle and a fluid retaining member.
Figure 2:
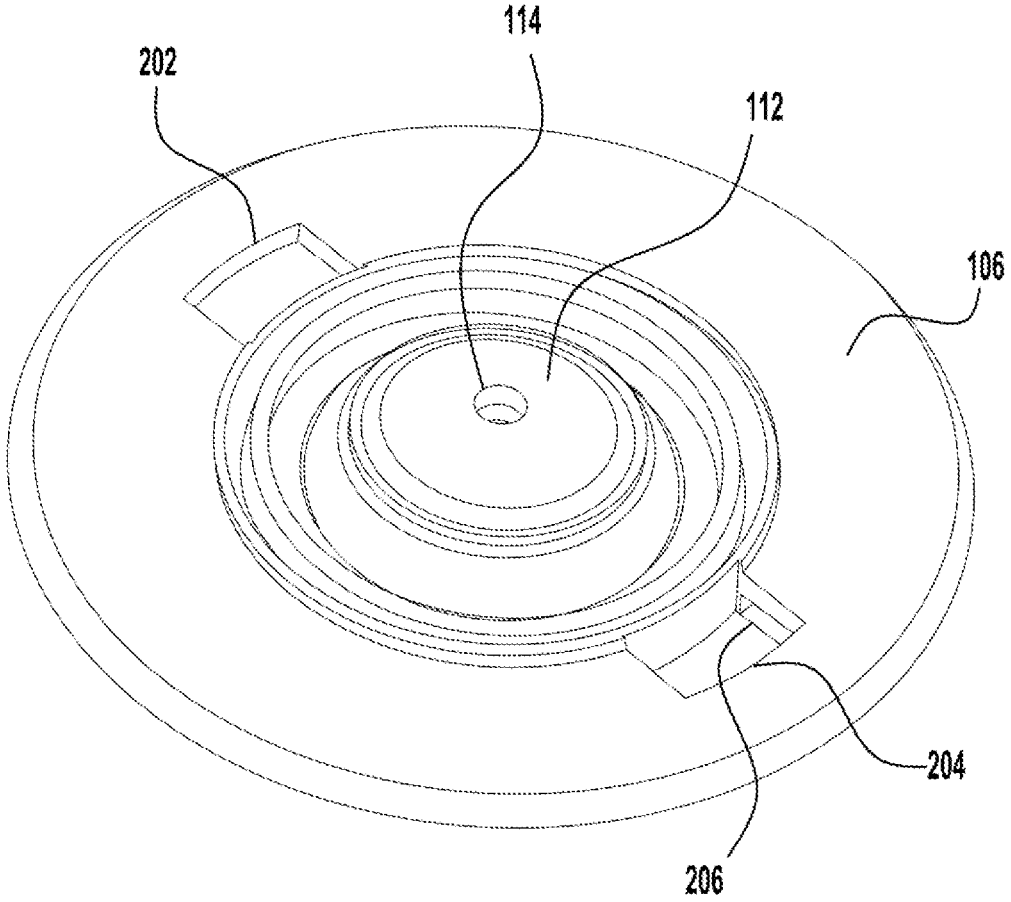
FIG. 2 illustrates a cap with a wipes dispensing nozzle located therein.

FIGS. 1 and 2 illustrate an exemplary embodiment of a wet wipes dispenser 100. Wipes dispenser 100 includes a container 102. Located inside of container 102 is a roll of wipes 104. The role of wipes 104 has periodic perforations 140 that are used to separate individual wipes from the role of wipes. In one embodiment, the wipes are individual wipes that are folded together such that the leading wipe pulls the trailing wipe through the opening before the two wipes separate. Wipes dispenser 100 includes a cap 106 secured to container 102. Cap 106 may be secured to container 102 by any means such as, for example, a threaded connection, a welded connection, a snap-fit connection, an adhesive bonding connection or the like.

Cap 106 includes a recessed portion 132 that has an aperture 120 to allow wipes 104*a* to pass therethrough. In addition, recessed portion 132 has a support ledge 130. Support ledge 130 supports an annular projection 118 of a dispensing nozzle 110.

Dispensing nozzle 110 is made of a resilient material such as, for example, silicon. Dispensing nozzle 110 includes a dome 112 that has a narrow aperture or opening 114 therethrough. Opening 114 has a circular cross-section that may expand as needed to allow the wipe 104*a* to be pulled through the opening 114. Nozzle 110 includes a fluid retaining member 116. Fluid retaining member 116 is an annular member that has a sloped surface. In one embodiment, the sloped surface traps and holds liquid. As shown, fluid retaining member 116 is integrally molded with dome 112; however, fluid retaining member 116 may optionally be a separate part.

Wipes dispenser 100 includes a retaining ring 136. Retaining ring 136 secures dispensing nozzle 110 to cap 106. Retaining ring 136 is retained with a snap-fit connection by projection 132 on cap 106 and projection 134 on retaining ring 136.

In one embodiment, cap 106 may include a snap cover (not shown). If a snap cover is provided, a hinged member may fit in opening 204 wherein projections extending from the cover fit into apertures 206 so that the cover may rotate. On the other side of the cover would be a snap connector that would snap into slot 202 to maintain the cover in a closed position. In embodiments where no cover is used, opening 204 and slot 202 may be eliminated.

During operation, wipe 104*a* is pulled up through dispensing nozzle 110. As wipe 104*a* is pulled up through narrow opening 114 of dispensing nozzle 110, liquid is squeezed or rung out of the wipe 104*a*. The liquid travels along the inside of dome 112 and runs down to fluid retaining member 116. The liquid contacts a portion of the wipe 104*a* that is passing by fluid retaining member 116 to re-wet the wipe 104*a*. Thus, fluid retaining member 116 helps ensure that all of the wipe 104*a* is wet. In addition, fluid retaining member 116 may hold liquid for a longer period of time and help keep the wipe 104*a* from drying out between uses. In one embodiment, fluid retaining member 116 and the size of opening 114 combine to eliminate the need for a re-closable cover (not shown) on cap 106.

In addition, during operation when a wipe is pulled through an orifice, liquid is often expelled from the wipe in the form of a spray, especially when the wipe is pulled from the container rapidly. In one embodiment, fluid retaining member 116 prevents the expelled liquid from spraying.

Figure 4:
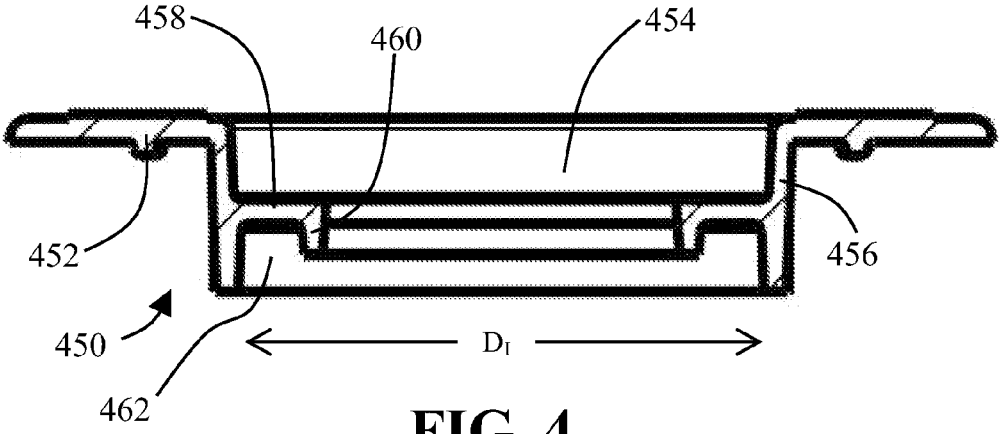
FIG. 4 illustrates a cross-sectional view of a support ring for use with the nozzle and fluid retaining member of FIG. 3.
Figure 3:
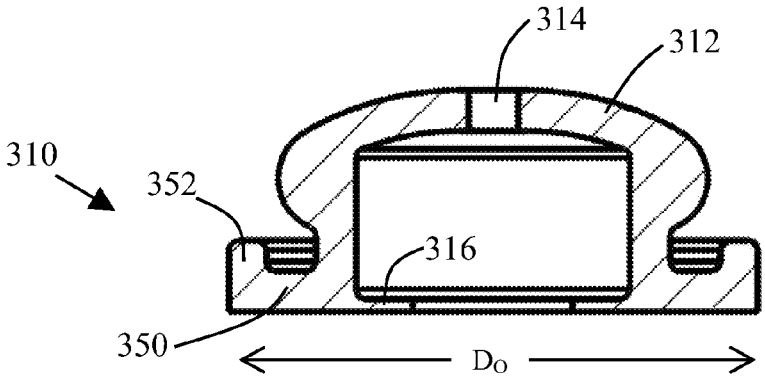
FIG. 3 illustrates a cross-sectional view of an alternative embodiment of a nozzle and a fluid retaining member.

FIGS. 3 and 4 respectively illustrate an alternative embodiment of a dispensing nozzle 310 and a support ring 450 for use with the dispensing nozzle 310. Dispensing nozzle 310 is made of a resilient material such as, for example, silicon.

Dispensing nozzle 310 includes a dome 312 that has a narrow aperture or opening 314 therethrough. Opening 314 has a circular cross-section that may expand as needed to allow a wipe 104*a* (not shown) to be pulled through the opening 314. Nozzle 310 includes a fluid retaining member 316. Fluid retaining member 316 is an annular member that has a non-sloped, horizontal surface. In one embodiment, the horizontal surface 316 traps and holds liquid. As shown, fluid retaining member 316 is integrally molded with dome 312; however, fluid retaining member 316 may optionally be a separate part. Dispensing nozzle 310 has an annular projection 350 underneath the dome 312. The annular projection 350 has an upwardly extending flange 352 on an outer end in order for the nozzle 310 to be received within the support ring 450, as described below.

Support ring 450 has a rim 452 for engagement with a cap (not shown) of a wet wipes dispenser. Support ring 450 includes a central opening 454 to allow wipes 104*a* to pass therethrough. An annular projection 456 extends down from the rim 452 in order to support the dispensing nozzle 310 within the central opening 454. Annular projection 456 has an inner diameter $D_1$ which is substantially equal to the outer diameter $D_o$ of the annular portion 350 of the dispensing nozzle 310 to provide a squeeze fit of the nozzle 310 within the annular projection 456. Annular projection 456 further includes a ring 458 extending inwardly from the annular projection 456 to end at an inner lip 460. Ring 458 and lip 460 form a receptacle 462 which receives the flange 352 of the nozzle 310 in a squeeze fit, helping to secure the nozzle 310 in place. Dispensing nozzle 310 may additionally or alternatively be secured to the support ring 450 by any other means such as, for example, a threaded connection, a welded connection, a snap-fit connection, an adhesive bonding connection, or the like.

As discussed above in connection with the cap 106, the supporting ring 450 may include elements for connecting to an optional snap cover (not shown).

During operation, wipe 104*a* is pulled up through dispensing nozzle 310. As wipe 104*a* is pulled up through narrow opening 314 of dispensing nozzle 310, liquid is squeezed or rung out of the wipe 104*a*. The liquid travels along the inside of dome 312 and runs down to fluid retaining member 316. The liquid contacts a portion of the wipe 104*a* that is passing by fluid retaining member 316 to re-wet the wipe 104*a*. Thus, fluid retaining member 316 helps ensure that all of the wipe 104*a* is wet. In addition, fluid retaining member 316 may hold liquid for a longer period of time and help keep the wipe 104*a* from drying out between uses. In one embodiment, fluid retaining member 316 and the size of opening 314 combine to eliminate the need for a re-closable cover (not shown) to be disposed over nozzle 310 and supporting ring 450.

In addition, during operation when a wipe is pulled through an orifice, liquid is often expelled from the wipe in the form of a spray, especially when the wipe is pulled from the container rapidly. In one embodiment, fluid retaining member 316 prevents the expelled liquid from spraying.

Although the nozzle embodiments 110 and 310 illustrated herein have a dome shape, other shapes are contemplated such as, for example, a conical shape. In addition, fluid retaining members 116 and 316 may have shapes that are not annular. In one exemplary embodiment, the opening of fluid retaining member 116 or 316 is a longitudinal slit. In another, the opening of fluid retaining member 116 or 316 has a star shape. Other optional shapes include polygonal openings and sinusoidal slits.

While the present invention has been illustrated by the description of embodiments thereof, and while the embodiments have been described in considerable detail, it is not the intention of the applicant to restrict or in any way limit the scope of the appended claims to such detail. Additional advantages and modifications will readily appear to those skilled in the art. For example, the fluid retaining member may be separate from the dome nozzle. Therefore, the invention, in its broader aspects, is not limited to the specific details, the representative apparatus and illustrative examples shown and described. Accordingly, departures may be made from such details without departing from the spirit or scope of the applicant's general inventive concept.

While the present invention has been illustrated by the description of embodiments thereof, and while the embodiments have been described in considerable detail, it is not the intention of the applicant to restrict or in any way limit the scope of the appended claims to such detail. Additional advantages and modifications will readily appear to those skilled in the art. For example, the fluid retaining member may be separate from the dome nozzle. Therefore, the invention, in its broader aspects, is not limited to the specific details, the representative apparatus and illustrative examples shown and described. Accordingly, departures may be made from such details without departing from the spirit or scope of the applicant's general inventive concept.

I claim:

1. A dispenser for dispensing wet wipes comprising:
a container;
a plurality of wet wipes contained within the container;
a dispensing nozzle made of a resilient material secured to the container;
an outlet opening sized to squeeze fluid out of the wet wipe as it is pulled through the dispensing nozzle; and
a fluid retaining member located at a point below the outlet opening;
wherein the fluid retaining member retains fluid squeezed out of the wipe.

2. The dispenser of claim 1 wherein the fluid retaining member and dispensing nozzle are a unitary member.

3. The dispenser of claim 1 wherein the dispensing nozzle and fluid retaining member comprise silicon.

4. The dispenser of claim 1 wherein the retaining member has an upward angled surface.

5. The dispenser of claim 1 wherein the dispensing nozzle is in the form of a flexible dome and the outlet is round.

6. The dispenser of claim 5 further comprising a cap for the container, wherein the dispensing nozzle is located in the cap and held in place by a retaining ring.

7. The dispenser of claim 1 wherein the fluid retaining ring is annular.

8. A wet wipes dispenser comprising:
a container for holding a plurality of wipes; and
a dispensing nozzle secured to the container;
the dispensing nozzle comprising a resilient member having an outlet; and
a fluid retaining member located below the outlet;
wherein the outlet is sized to squeeze fluid out a wipe;
wherein fluid that is squeezed out of the wipe contacts the fluid retaining member
and contacts the wipe as it is being dispensed.

9. The wet wipes dispenser of claim 8 further comprising a plurality of wipes.

10. The wet wipes dispenser of claim 8 wherein the fluid retaining member and dispensing nozzle are a unitary member.

11. The wet wipes dispenser of claim 8 wherein the dispensing nozzle and the fluid retaining member comprise silicon.

12. The wet wipes dispenser of claim 8 wherein the retaining member has a sloped surface.

13. The wet wipes dispenser of claim 8 wherein the dispensing nozzle is in the form of a dome and the outlet is round.

14. A dispensing nozzle for wet wipes comprising:

a resilient dome shaped member;

an outlet opening located in the dome shaped member; and an annular fluid retaining ring;

wherein the outlet is sized to squeeze fluid out a wipe and the fluid is retained by the fluid retaining ring; and wherein the annular fluid retaining ring is configured to contact a wipe as it is being pulled out of the dispensing nozzle.

15. The dispensing nozzle of claim 14 further comprising a container and a roll of wipes.

16. The dispensing nozzle of claim 14 wherein the fluid retaining member and resilient dome shaped member are a unitary piece.

17. The dispenser of claim 14 wherein the dispensing nozzle and fluid retaining member comprise silicon.

18. The dispensing nozzle of claim 14 wherein the retaining member has a surface that is angled upward.

19. The dispensing nozzle of claim 14 wherein the outlet opening is round.

20. The dispensing nozzle of claim 14 further comprising a cap for the container, wherein the dispensing nozzle is located in the cap and held in place by a retaining ring.

* * * * *